US008228244B2

(12) United States Patent
Wong et al.

(10) Patent No.: US 8,228,244 B2
(45) Date of Patent: Jul. 24, 2012

(54) DUAL-BAND MOBILE COMMUNICATION DEVICE AND ANTENNA STRUCTURE THEREOF

(75) Inventors: Kin-Lu Wong, Tapei Hsien (TW); Chih-Hua Chang, Tapei Hsien (TW)

(73) Assignee: Acer Inc., Taipei Hsien (TW)

( * ) Notice: Subject to any disclaimer, the term of this patent is extended or adjusted under 35 U.S.C. 154(b) by 308 days.

(21) Appl. No.: 12/775,578

(22) Filed: May 7, 2010

(65) Prior Publication Data

US 2011/0187606 A1 Aug. 4, 2011

(30) Foreign Application Priority Data

Feb. 1, 2010 (TW) ..... 99102889 A

(51) Int. Cl.
*H01Q 1/24* (2006.01)
*H01Q 1/38* (2006.01)

(52) U.S. Cl. ..... 343/702; 343/700 MS

(58) Field of Classification Search ..... 343/702, 343/700 MS, 846, 848
See application file for complete search history.

(56) References Cited

U.S. PATENT DOCUMENTS 6,061,024 A * 5/2000 McGirr et al. ..... 343/700 MS
2004/0116157 A1* 6/2004 Vance et al. ..... 455/562.1
2009/0115664 A1* 5/2009 Chung et al. ..... 343/700 MS

FOREIGN PATENT DOCUMENTS

TW I308409 4/2009

* cited by examiner

*Primary Examiner* — Hoanganh Le
(74) *Attorney, Agent, or Firm* — Alan Kamrath; Kamrath IP Lawfirm, PA

(57) ABSTRACT

A dual-band mobile communication device includes a circuit board, a ground plane, an antenna element, and a dual-band inductively-coupled element. The ground plane has an edge. The antenna element is located on the circuit board or adjacent to the circuit board. The antenna element has a first operating band and a second operating band. The dual-band inductively-coupled element is located at the edge of the ground plane. The dual-band inductively-coupled element excites two different resonant modes at two specific frequencies corresponding to the first and the second operating bands of the antenna element, respectively. The dual-band inductively-coupled element comprises a connection element, an inductive element, a first metal plate, and a second metal plate. The first metal plate is electrically connected to the ground plane through the connection element. The second metal plate is electrically connected to the inductive element.

11 Claims, 6 Drawing Sheets

DUAL-BAND MOBILE COMMUNICATION DEVICE AND ANTENNA STRUCTURE THEREOF

BACKGROUND OF THE INVENTION

1. Field of the Invention

The present invention relates to a dual-band mobile communication device and a related antenna structure; more particularly, the present invention relates to a dual-band mobile communication device and a related antenna structure having a dual-band inductively-coupled element capable of exciting two resonant modes as well as enhancing bandwidths in both a lower operating band and a higher operating band of the antenna at the same time.

2. Description of the Related Art

With the vigorous development of mobile communication techniques, a variety of wireless communication products keep coming out one after another, and therefore the mobile communication devices have been tightly bonded to people's daily lives, wherein mobile phones are most popular and most widely used among all these communication products. Currently, it is the trend to design a mobile phone in a compact and small size. However, whether the operating bandwidth of a conventional mobile phone antenna is in a low operating band (such as GSM850/900) or a high operating band (such as GSM1800/1900/UMTS), it may greatly influence the size changes of the system ground plane. Therefore, if there is a need to directly applying a conventional mobile phone antenna in a mobile phone with a small-sized system ground plane, the antenna has to be re-designed due to the reduction of the operating bandwidth. Generally, the size of the antenna has to be enlarged in order to acquire enough operating bandwidth; however, this would significantly increase the difficulty of installing the antenna in a small-sized mobile phone.

For example, a dual-band antenna design for application in a mobile phone is disclosed in Taiwan Patent No. 1308,409 (An internal thin dual-band handset antenna). However, if the length of the system ground plane of such an antenna is shortened, the bandwidths of the low operating band and the high operating band will be affected and thereby reduced. Therefore, the overall size of the antenna needs to be enlarged so as to improve the operating bandwidths.

Therefore, there is a need to provide a dual-band mobile communication device to mitigate and/or obviate the aforementioned problems.

SUMMARY OF THE INVENTION

It is an object of the present invention to provide a dual-band mobile communication device, which has a dual-band inductively-coupled element capable of exciting two different resonant modes at two specific frequencies corresponding to a low operating band and a high operating band of an antenna at the same time, thereby significantly lessening the influence of reducing the operating bandwidth of the antenna due to the size reduction of the ground plane. In the dual-band mobile communication device of the present invention, without the need for changing the original structural size of the antenna, the bandwidths of the low operating band and the high operating band of the antenna can be effectively increased to cover the requirements of wireless communication frequency bands. Furthermore, because the dual-band inductively-coupled element is small, it can be easily placed in the mobile communication device without affecting the overall size of the mobile communication device.

It is an another object of the present invention to provide an antenna structure, which has a dual-band inductively-coupled element capable of exciting two different resonant modes at two specific frequencies corresponding to a low operating band and a high operating band of an antenna at the same time.

To achieve the abovementioned objects, the dual-band mobile communication device of the present invention comprises: a circuit board, a ground plane, an antenna element, and a dual-band inductively-coupled element.

The ground plane is located on the circuit board, and the ground plane has an edge; the antenna element is located on the circuit board or placed adjacent to the circuit board. The antenna element has a first operating band and a second operating band. The dual-band inductively-coupled element is located at the edge of the ground plane. The dual-band inductively-coupled element excites two different resonant modes at two specific frequencies corresponding to the first operating band and the second operating band of the antenna element, respectively. The dual-band inductively-coupled element includes a connection element; a first metal plate, electrically connected to the ground plane through the connection element; an inductive element; and a second metal plate, electrically connected to the inductive element.

To achieve the abovementioned objects, the antenna structure of the present invention includes: a ground plane, an antenna element, and a dual-band inductively-coupled element. The ground plane has an edge. The antenna element has a first operating band and a second operating band. The dual-band inductively-coupled element is located at the edge of the ground plane. The dual-band inductively-coupled element excites two different resonant modes at two specific frequencies corresponding to the first operating band and the second operating band of the antenna element, respectively. The dual-band inductively-coupled element includes: a connection element; a first metal plate, electrically connected to the ground plane through the connection element; an inductive element; and a second metal plate, electrically connected to the inductive element.

According to one preferred embodiment of the present invention, the connection element or the inductive element may be a chip inductor. The dual-band inductively-coupled element is located on a dielectric substrate, wherein the dielectric substrate is substantially perpendicular to the circuit board.

Other objects, advantages, and novel features of the invention will become more apparent from the following detailed description when taken in conjunction with the accompanying drawings.

BRIEF DESCRIPTION OF THE DRAWINGS

These and other objects and advantages of the present invention will become apparent from the following description of the accompanying drawings, which disclose several embodiments of the present invention. It is to be understood that the drawings are to be used for purposes of illustration only, and not as a definition of the invention.

In the drawings, wherein similar reference numerals denote similar elements throughout the several views.

DETAILED DESCRIPTION OF THE PREFERRED EMBODIMENT

Figure 1:
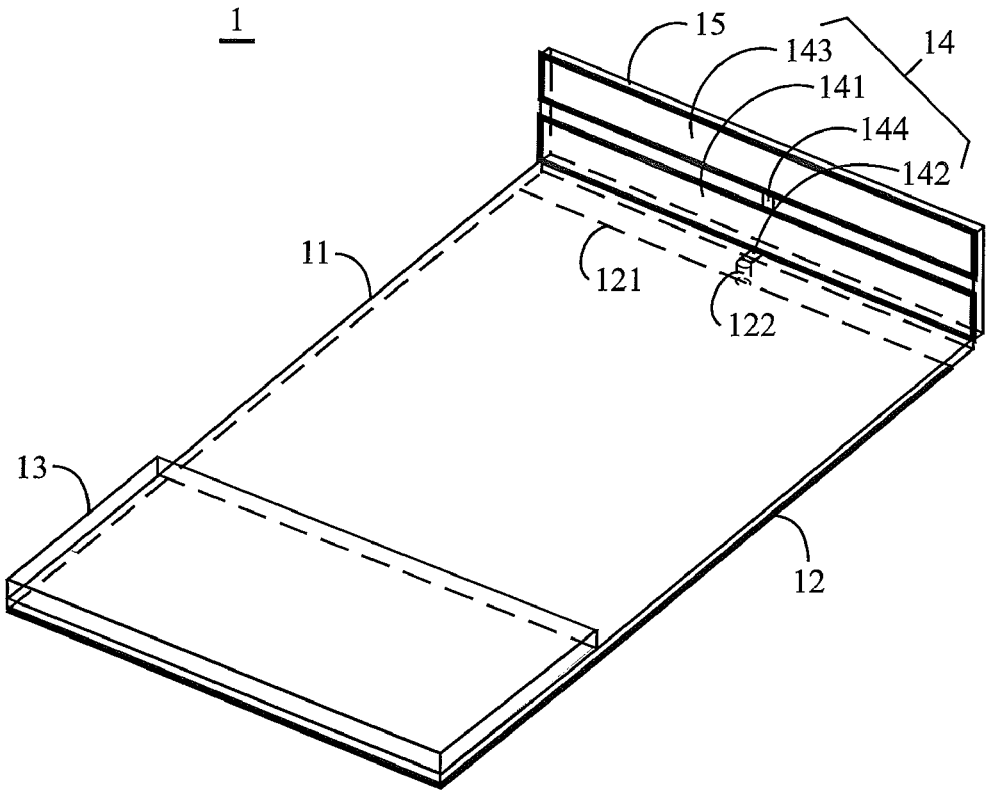
FIG. 1 illustrates a structural drawing of a dual-band mobile communication device and an antenna structure in a first embodiment of the present invention.

Please refer to FIG. 1, which illustrates a structural drawing of a dual-band mobile communication device and an antenna structure in a first embodiment of the present invention. The dual-band mobile communication device 1 includes a circuit board 11 and an antenna structure, wherein the antenna structure includes a ground plane 12, an antenna element 13, and a dual-band inductively-coupled element 14.

The ground plane 12 is located on the circuit board 11, and the ground plane 12 has an edge 121. The antenna element 13 is located on the circuit board 11, and the antenna element 13 has a first operating band and a second operating band.

The dual-band inductively-coupled element 14 is located at the edge 121 of the ground plane 12. The dual-band inductively-coupled element 14 excites two different resonant modes at two specific frequencies corresponding to the first operating band and the second operating band of the antenna element 13, respectively.

The dual-band inductively-coupled element 14 includes a connection element 142, a first metal plate 141, an inductive element 144, and a second metal plate 143. In this embodiment, the first metal plate 141 is electrically connected to the ground plane 12 through the connection element 141, wherein the connection element 142 is implemented by a first inductive element. In addition, the second metal plate 143 is electrically connected to the first metal plate 141 through the inductive element 144, and the second metal plate 143 is further electrically connected to the ground plane 12 through the inductive element 144. In this embodiment, the connection element 142 may be an inductive element, and the inductive element may be implemented by a chip inductor. In another embodiment, the connection element 142 may be a connection metal line (see the fourth embodiment in FIG. 5). By means of the inductive elements, the size of the dual-band inductively-coupled element and the size of the antenna structure can be reduced to facilitate installation in the mobile communication device. If no inductive element were used, the size of the metal plate required for achieving resonance would be significantly increased.

The dual-band inductively-coupled element 14 mainly utilizes the combination of the metal plates and the inductive elements to excite two resonant paths. The longer resonant path is composed of the connection element 142, the first metal plate 141, the inductive element 144 and the second metal plate 143, and the longer resonant path is capable of exciting a resonant mode at a lower frequency of around 900 MHz. The shorter resonant path is composed of only the connection element 142 (i.e., the first inductive element) and the first metal plate 141, and the shorter resonant path is capable of exciting a resonant mode at a higher frequency of around 1800 MHz.

In this embodiment, the dual-band inductively-coupled element 14 is located on a dielectric substrate 15, wherein the dielectric substrate 15 is substantially perpendicular to the circuit board 11. The connection element 142 (i.e., the first inductive element) or the inductive element 144 can be a chip inductor, but the present invention is not limited to this only.

Figure 2:
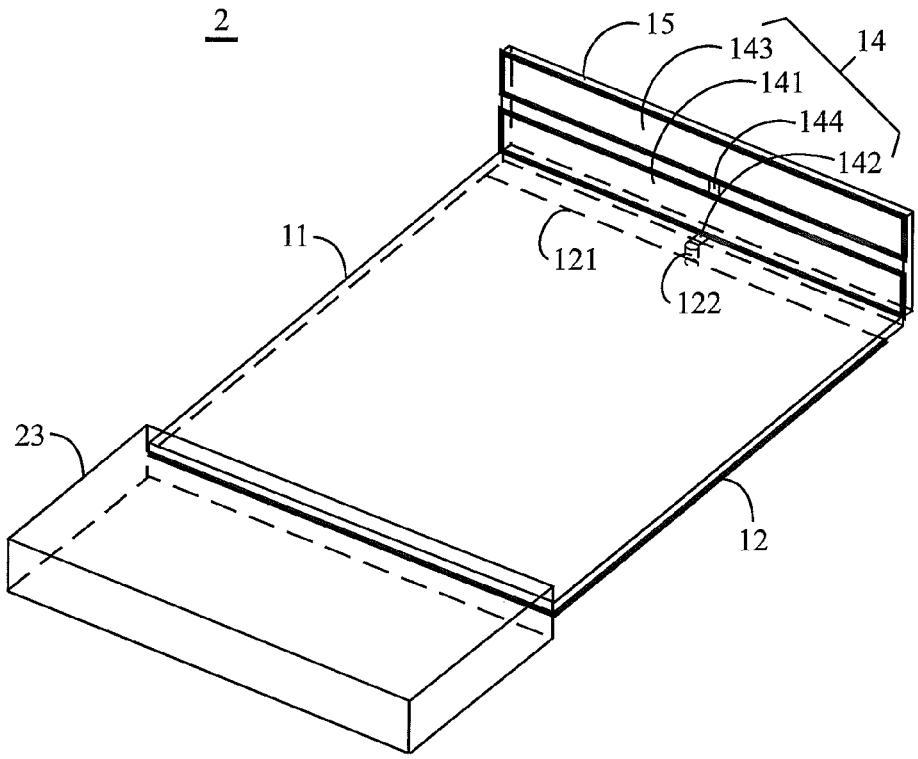
FIG. 2 illustrates a structural drawing of a dual-band mobile communication device and an antenna structure in a second embodiment of the present invention.

Please refer to FIG. 2, which illustrates a structural drawing of a dual-band mobile communication device and an antenna structure in a second embodiment of the present invention. The dual-band mobile communication device 2 includes a circuit board 11 and an antenna structure, wherein the antenna structure includes a ground plane 12, an antenna element 23, and a dual-band inductively-coupled element 14. The structural difference between this and the first embodiment is as follows: the antenna element 23 in this embodiment is placed adjacent to the circuit board 11, rather than being directly placed on the circuit board 11. The second embodiment can also achieve results similar to those achieved by the first embodiment.

Figure 3:
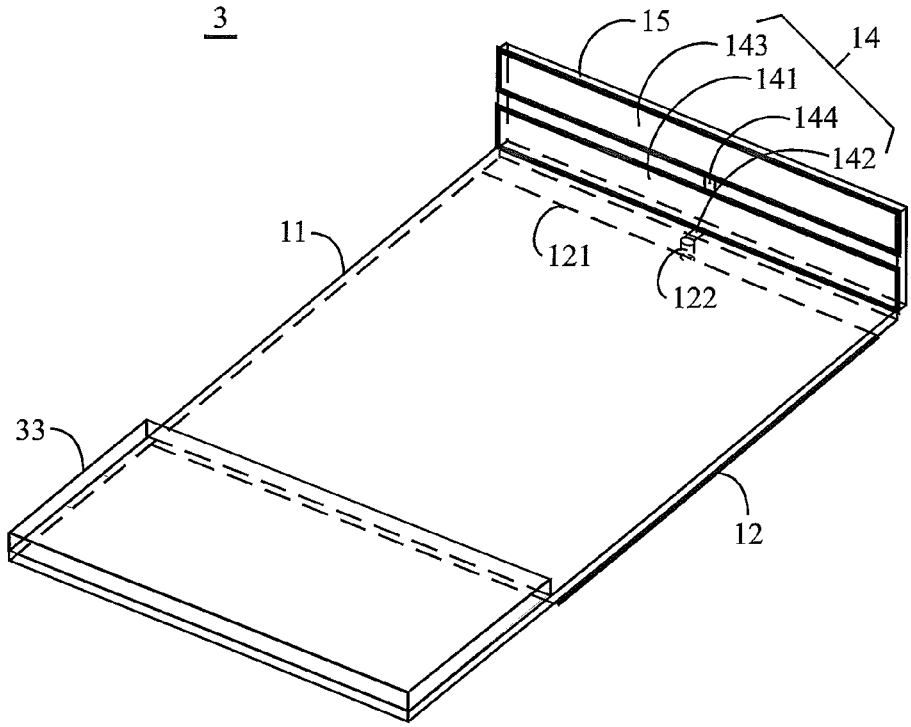
FIG. 3 illustrates a structural drawing of a dual-band mobile communication device and an antenna structure in a third embodiment of the present invention.

Please refer to FIG. 3, which illustrates a structural drawing of a dual-band mobile communication device and an antenna structure in a third embodiment of the present invention. The dual-band mobile communication device 3 includes a circuit board 11 and an antenna structure, wherein the antenna structure includes a ground plane 12, an antenna element 33, and a dual-band inductively-coupled element 14. The structural difference between this and the first embodiment is as follows: although the antenna element 33 in this embodiment is also located on the circuit board 11, there is no overlap between the antenna element 33 and the ground plane 12. The third embodiment can also achieve results similar to those achieved by the first embodiment.

Figure 4:
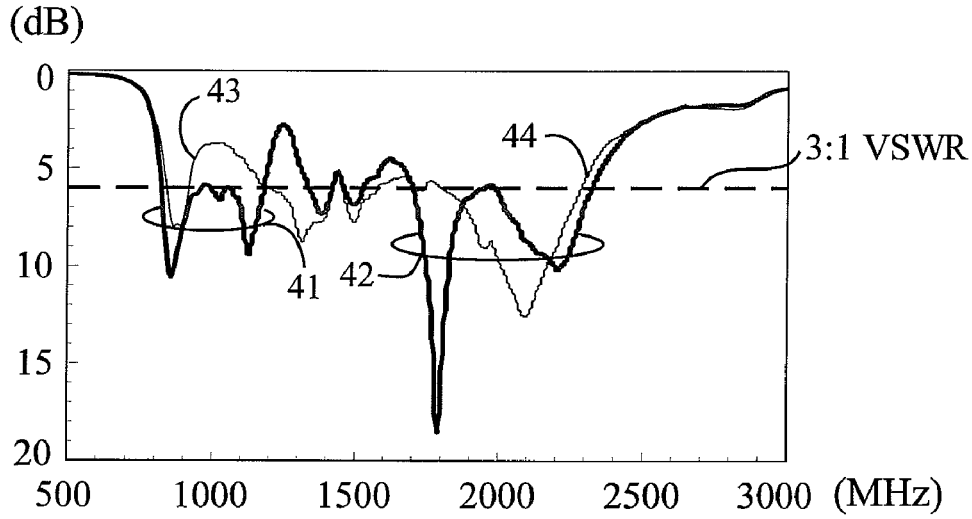
FIG. 4 illustrates a diagram of a measured return loss of the dual-band mobile communication device in the third embodiment of the present invention.

Please refer to FIG. 4, which illustrates a diagram of a measured return loss of the third embodiment. In the third embodiment, the experimental measurement is performed according to the following design: The circuit board 11 is about 85 mm in length and about 40 mm in width; the ground plane 12 is only about 70 mm in length and about 40 mm in width; the volume of the antenna element 33 is 40×15×6 $mm^3$; and the dual-band inductively-coupled element 14 comprises the first metal plate 141, with a size of about 40×2 $mm^2$; and the second metal plate 143, with a size of about 40×3 $mm^2$, wherein the overall size of the dual-band inductively-coupled element 14 is about 40×6 $mm^2$, and the dual-band inductively-coupled element 14 is located on the dielectric substrate 15 to facilitate installation in the mobile communication device without increasing the length of the mobile communication device; the connection element 142 (i.e., the first inductive element) and the inductive element 144 are chip inductors with respective inductance values of about 3 nH and 8 nH.

From the experiment results, with the definition of 6-dB return loss, in the third embodiment, the first (i.e., low frequency) operating band 41 and the second (i.e., high frequency) operating band 42 can respectively cover the frequency bands of GSM850/900 (824896 MHz) and GSM1800/1900/UMTS (1710-2170 MHz). Please also note that if the third embodiment did not have the dual-band inductively-coupled element 14, the bandwidths of the first (low frequency) operating band 43 and the second (high frequency) operating band 44 of the antenna element 33 without the dual-band inductively-coupled element would be significantly affected by the small-sized ground plane 12. According to the experimental results shown in FIG. 4, the first (low frequency) operating band 43 is at around 900 MHz, but its bandwidth is significantly reduced because it is not able to cover the frequency band of GSM850/900; meanwhile, the second (high frequency) operating band 44 is not able to cover the bandwidth of GSM1800/1900/UMTS, either. Because the dual-band inductively-coupled element 14 is capable of exciting resonant modes at both the low frequency of 900 MHz and the high frequency of 1800 MHz at the same time, the dual-band inductively-coupled element 14 can indeed increase the bandwidths in both the 900 MHz and the 1800 MHz ranges of the antenna element 33 at the same time.

Figure 5:
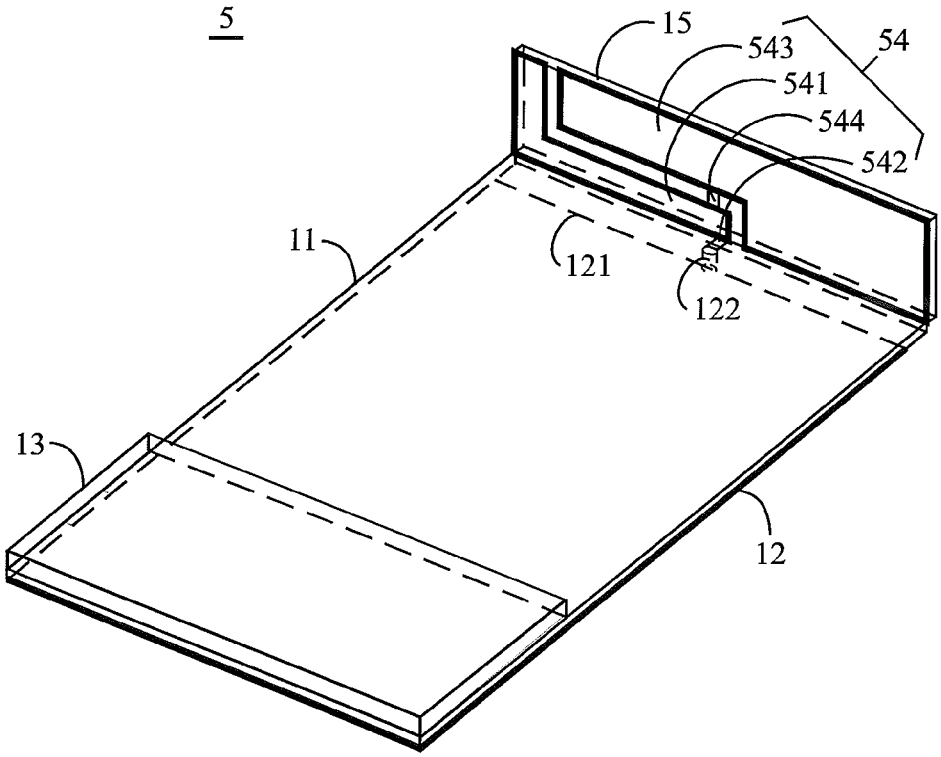
FIG. 5 illustrates a structural drawing of a dual-band mobile communication device and an antenna structure in a fourth embodiment of the present invention.

Please refer to FIG. 5, which illustrates a structural drawing of a dual-band mobile communication device and an antenna structure in a fourth embodiment of the present invention. The dual-band mobile communication device 5 includes a circuit board 11 and an antenna structure, wherein the antenna structure includes a ground plane 12, an antenna element 13, and a dual-band inductively-coupled element 54. The structural difference between this and the first embodiment is as follows: the first metal plate 541 of the dual-band inductively-coupled element 54 can also be electrically connected to the ground plane 12 through a connection metal line 542, being a connection element for replacing the abovementioned first inductive element. Because generally a large current will pass through the electrical connection junction, the connection metal line 542 can also effectively generate equivalent series inductance. The fourth embodiment can also achieve results similar to those achieved by the first embodiment.

Figure 6:
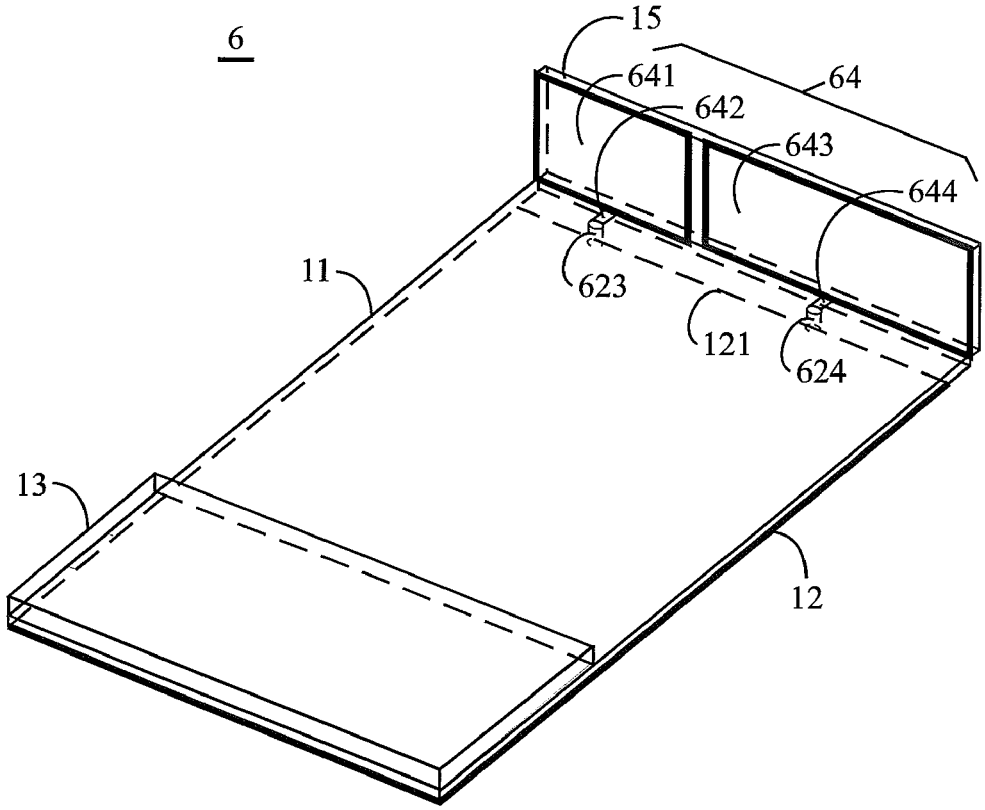
FIG. 6 illustrates a structural drawing of a dual-band mobile communication device and an antenna structure in a fifth embodiment of the present invention.

Please refer to FIG. 6, which illustrates a structural drawing of a dual-band mobile communication device and an antenna structure in a fifth embodiment of the present invention. The dual-band mobile communication device 6 includes a circuit board 11 and an antenna structure, wherein the antenna structure includes a ground plane 12, an antenna element 13, and a dual-band inductively-coupled element 64. The structural difference between this and the first embodiment is as follows: the second metal plate 643 of the dual-band inductively-coupled element 64 can also be directly electrically connected to the ground plane 12 through the inductive element 644. The fifth embodiment can also achieve results similar to those achieved by the first embodiment.

According to the above description, in the dual-band mobile communication device of the present invention, by means of the inductance values provided by the connection element (may be implemented by an inductive element or a connection metal line) and the inductive element (or the connection metal line and the inductive element), the dual-band inductively-coupled element can excite two different resonant modes at two specific frequencies (such as around 900 MHz and 1800 MHz) under a small-sized condition, so as to provide two additional modes as well as to enhance bandwidths in both the first (low frequency) operating band and the second (high frequency) operating band of the antenna element.

Although the present invention has been explained in relation to its preferred embodiments, it is to be understood that many other possible modifications and variations can be made without departing from the spirit and scope of the invention as hereinafter claimed.

What is claimed is:

1. A dual-band mobile communication device, comprising:

a circuit board;

a ground plane, located on the circuit board, the ground plane having an edge;

an antenna element, located on the circuit board or placed adjacent to the circuit board, the antenna element having a first operating band and a second operating band; and a dual-band inductively-coupled element, located at the edge of the ground plane, the dual-band inductively-coupled element exciting two different resonant modes at two specific frequencies corresponding to the first operating band and the second operating band of the antenna element, respectively, the dual-band inductively-coupled element comprising:

a connection element;

a first metal plate, electrically connected to the ground plane through the connection element;

an inductive element; and a second metal plate, electrically connected to the inductive element.

2. The dual-band mobile communication device as claimed in claim 1, wherein the connection element comprises an inductive element or a connection metal line; and the inductive element is a chip inductor.

3. The dual-band mobile communication device as claimed in claim 1, wherein the inductive element is a chip inductor.

4. The dual-band mobile communication device as claimed in claim 1, wherein the second metal plate is further electrically connected to the first metal plate through the inductive element.

5. The dual-band mobile communication device as claimed in claim 1, wherein the second metal plate is further electrically connected to the ground plane through the inductive element.

6. The dual-band mobile communication device as claimed in claim 1, wherein the dual-band inductively-coupled element is located on a dielectric substrate, and the dielectric substrate is substantially perpendicular to the circuit board.

7. An antenna structure, comprising:

a ground plane, having an edge;

an antenna element, having a first operating band and a second operating band; and a dual-band inductively-coupled element, located at the edge of the ground plane, the dual-band inductively-coupled element exciting two different resonant modes at two specific frequencies corresponding to the first operating band and the second operating band of the antenna element, respectively, the dual-band inductively-coupled element comprising:

a connection element;

a first metal plate, electrically connected to the ground plane through the connection element;

an inductive element; and a second metal plate, electrically connected to the inductive element.

8. The antenna structure as claimed in claim 7, wherein the connection element comprises an inductive element or a connection metal line; and the inductive element is a chip inductor.

9. The antenna structure as claimed in claim 7, wherein the inductive element is a chip inductor.

10. The antenna structure as claimed in claim 7, wherein the second metal plate is further electrically connected to the first metal plate through the inductive element.

11. The antenna structure as claimed in claim 7, wherein the second metal plate is further electrically connected to the ground plane through the inductive element.

* * * * *